US007027014B2

(12) United States Patent
Sato et al.

(10) Patent No.: US 7,027,014 B2
(45) Date of Patent: Apr. 11, 2006

(54) ORGANIC EL DISPLAY DEVICE

(75) Inventors: Yasushi Sato, Tokyo (JP); Takuya Higuchi, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/994,241

(22) Filed: Nov. 23, 2004

(65) Prior Publication Data

US 2005/0140607 A1 Jun. 30, 2005

(30) Foreign Application Priority Data

Nov. 27, 2003 (JP) ..... P2003-397806

(51) Int. Cl.
*G09G 3/32* (2006.01)

(52) U.S. Cl. ..... 345/76; 345/82; 315/169.3

(58) Field of Classification Search .. 315/169.1–169.4; 345/44–46, 76–84, 204
See application file for complete search history.

(56) References Cited

U.S. PATENT DOCUMENTS 4,443,741 A * 4/1984 Tanaka et al. ..... 315/169.3
6,320,330 B1 * 11/2001 Haavisto et al. ..... 315/291
6,693,388 B1 * 2/2004 Oomura ..... 345/76
6,812,650 B1 * 11/2004 Yasuda et al. ..... 345/76
6,870,322 B1 * 3/2005 Mizukoshi et al. ..... 345/76

FOREIGN PATENT DOCUMENTS

JP 2002-091377 3/2002

* cited by examiner

*Primary Examiner*—Wilson Lee
(74) *Attorney, Agent, or Firm*—Finnegan, Henderson, Farabow, Garrett & Dunner, L.L.P.

(57) ABSTRACT

Disclosed is an organic EL display device which includes a light emitter; a current controller controlling a current to be fed to the light emitter; a current detector detecting a value of current flowing through the light emitter as a voltage; a first switching unit switching between transmission and non-transmission of a voltage value corresponding to the detected current; a comparison amplifier comparing and amplifying the voltage value transmitted from the first switching unit to a voltage value corresponding to the image signal; a second switching unit switching between transmission and non-transmission of the voltage value being a result of the comparison and amplification; and an image signal holding capacitor charged/discharged based on the voltage value transmitted from the second switching unit, the current controller controlling the current to be fed to the light emitter based on a charging voltage of the image signal holding capacitor.

8 Claims, 6 Drawing Sheets

ORGANIC EL DISPLAY DEVICE

BACKGROUND

1. Field of the Invention

The present invention relates to an organic EL display device which performs display using self-luminous EL (electroluminescence) elements as pixels which are arranged in a matrix form and, more specifically, to an organic EL display device suitable for reducing variations in luminance among pixels.

2. Description of the Related Art

Display devices employing organic EL elements have characteristics, not realized by LCDs (liquid crystal display devices), in that the organic EL elements require no backlights because they are self-luminous elements and thus suitable for reducing power consumption. Those display devices further have fast response and wide viewing angle characteristics, and also have advantages that they are adaptable to flexible applications and so on since the elements themselves are solid.

Possible systems of driving the organic EL display device include, similarly to LCD, PM (passive matrix) drive and AM (active matrix) drive, and the AM system is mainstream in which a thin film transistor (TFT) is provided for each pixel to individually control the pixel. This also allows for higher definition, longer life, and much lower power consumption.

Incidentally, to control the light emission of pixels of the organic EL display device without variations, it is necessary to make current values of the pixels identical to each other with respect to a certain image signal. This point is particularly important for a system in which the pixels are supplied with the image signal in an analog signal and are caused to perform intermediate light emission in accordance with its analog value. Examples of the organic EL display device aimed at reducing unevenness of luminance on the precondition described above include, for example, one described in the following Patent Document 1.

[Patent Document 1] Japanese Patent Laid-Open Application No. 2002-91377

In the display device disclosed in the above document, a configuration is employed which negatively feeds back pixel currents such that the current match an image signal. Accordingly, even if there are variations in input voltage versus output current characteristics of current controller circuits, the variations are absorbed so that current values among pixels identical to a certain image signal are obtained. However, necessarily, an error amplifier circuit required for negative feedback needs to be built in for each pixel, and therefore it is considered that the display device has a disadvantage in the aperture rate of display (rate of net area of light emitter to surface area).

SUMMARY

The present invention has been developed in consideration of the above-mentioned circumstances, and an object thereof is to provide an organic EL display device using self-luminous organic EL elements as pixels, which are arranged in a matrix form to perform display, in which variations in luminance among the pixels are reduced and sacrifice to the aperture rate is also small.

An organic EL display device according to the present invention, in which a plurality of pixels are arranged in a matrix form, a pixel is selected from among the plurality of pixels in accordance with a pixel selection signal and the selected pixel is caused to emit light in accordance with an image signal, includes: a light emitter; a current controller controlling a current to be fed to the light emitter; a current detector detecting a value of current flowing through the light emitter as a voltage; a first switching unit switching between transmission and non-transmission of a voltage value corresponding to the detected current, in accordance with the pixel selection signal; a comparison amplifier comparing and amplifying the voltage value transmitted from the first switching unit to a voltage value corresponding to the image signal; a second switching unit switching between transmission and non-transmission of the voltage value being a result of the comparison and amplification, in accordance with the pixel selection signal; and an image signal holding capacitor charged/discharged based on the voltage value transmitted from the second switching unit, the current controller controlling the current to be fed to the light emitter based on a charging voltage of the image signal holding capacitor.

In this configuration, the image signal is inputted into one input of the comparison amplifier, and voltage is supplied to the other input from the current detector via the first switching unit. Further, output from the comparison amplifier is supplied to the image signal holding capacitor and the current controller via the second switching unit. In such a configuration, it is easily realized to use the first switching unit in each pixel as a multiplexer and the second switching unit in each pixel as a demultiplexer. More specifically, it is sufficient to provide one comparison amplifier for a plurality of pixels, avoiding the necessity for providing the comparison amplifier for each pixel. This can eliminate the cause to reduce the aperture rate. Further, negative feedback is performed by the comparison amplifier so that even if there are variations in the input voltage versus output current characteristics of the current controllers, the variations are absorbed so that current values can be obtained which are identical among the pixels to a certain image signal.

The organic EL display device according to the present invention has the comparison amplifier for negative feedback, but the comparison amplifier does not need to be provided for each pixel, the variations in luminance among the pixels can be reduced and the sacrifice to the aperture rate can be made very small.

DETAILED DESCRIPTION

DESCRIPTION OF EMBODIMENTS

Figure 1:
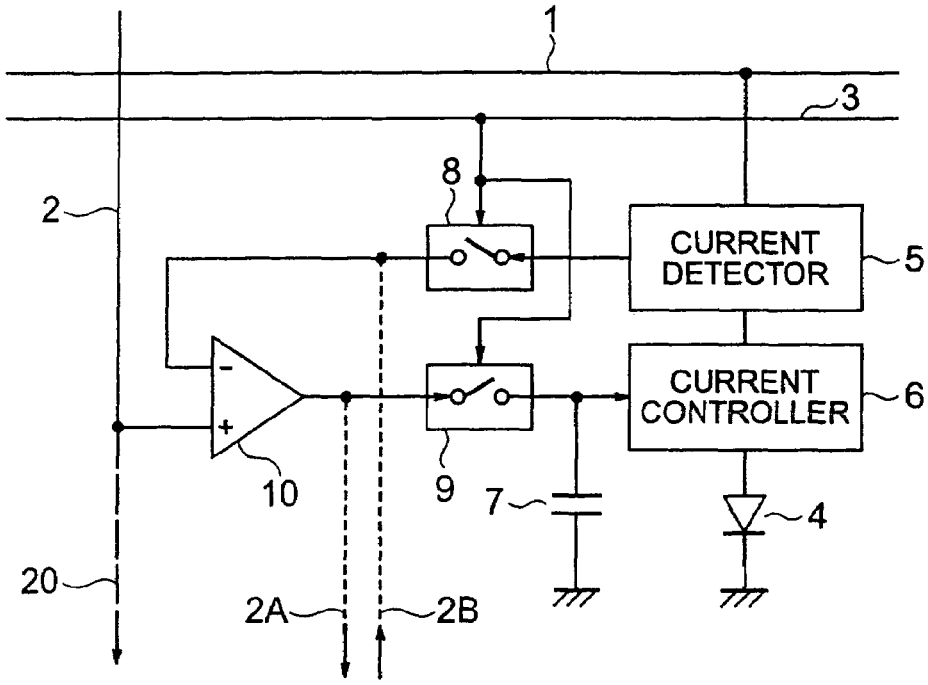
FIG. 1 is a block diagram showing a configuration of a particular pixel in an organic EL display device according to an embodiment of the present invention.

Embodiments of the present invention will be described with reference to the drawings which are not intended to limit the invention by any means but are provided only for the purpose of illustration.

As a form of an embodiment of the present invention, the aforementioned current detector can be a resistor inserted and connected between a power supply and the aforementioned current controller, and the aforementioned light emitter can be inserted and connected between the current controller and ground. This configuration employs as the current detector the resistor having a simple configuration and the light emitter formed based on ground.

Here, the current detector may detect the value of current flowing through the light emitter as voltage through use of the on-state resistance of a thin film transistor inserted and connected between the power supply and the current controller. This avoids the necessity for building in the resistor, bringing about advantages over manufacture process.

Here, the current controller can be an n-channel thin film transistor configured such that the current to be fed to the light emitter is outputted as the drain/source current which is controlled by the charging voltage of the aforementioned image signal holding capacitor supplied to the gate. This is the configuration where an n-channel thin film capacitor is used as the current controller.

Further, the current controller can be a p-channel thin film transistor configured such that the current to be fed to the light emitter is outputted as the source/drain current which is controlled by the charging voltage of the image signal holding capacitor supplied to the gate. This is the configuration where a p-channel thin film capacitor is used as the current controller.

As another form, the current detector can be a resistor inserted and connected between ground and the current controller, and the light emitter can be inserted and connected between the current controller and a power supply. This configuration employs as the current detector a resistor having a simple configuration and the light emitter formed based on the power supply.

Here again the current controller can be an n-channel thin film transistor configured such that the current to be fed to the light emitter is outputted as the drain/source current which is controlled by the charging voltage of the image signal holding capacitor supplied to the gate.

As still another form, the light-emitter, the current controller, the current detector, the aforementioned first switching unit, the aforementioned second switching unit, and the image signal holding capacitor can be provided for each of the plurality of pixels, and the aforementioned comparison amplifier can be provided for each column of the aforementioned pixels in the matrix form, in which the first switching unit of every pixel included by a column of pixels to which the comparison amplifier belongs is connected to the comparison amplifier, and the comparison amplifier is connected to the second switching unit of every pixel included by a column of pixels to which the comparison amplifier belongs. This is the configuration in which the first and second switching units as a multiplexer or a demultiplexer as previously described are used for each column of pixels as a group in the matrix form. This requires only one comparison amplifier for each column and thus can reduce the number of comparison amplifiers to be built in to a minimum.

Figure 9A:
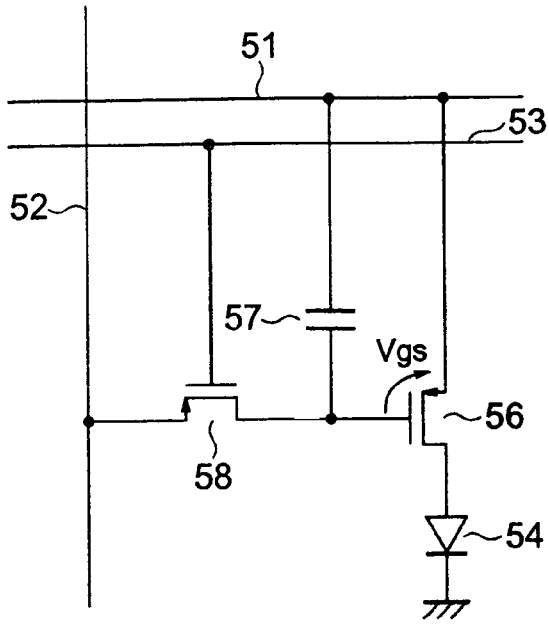
FIG. 9A and FIG. 9B are equivalent circuit diagrams each showing a configuration of each pixel of the organic EL display device as comparison examples.
Figure 9B:
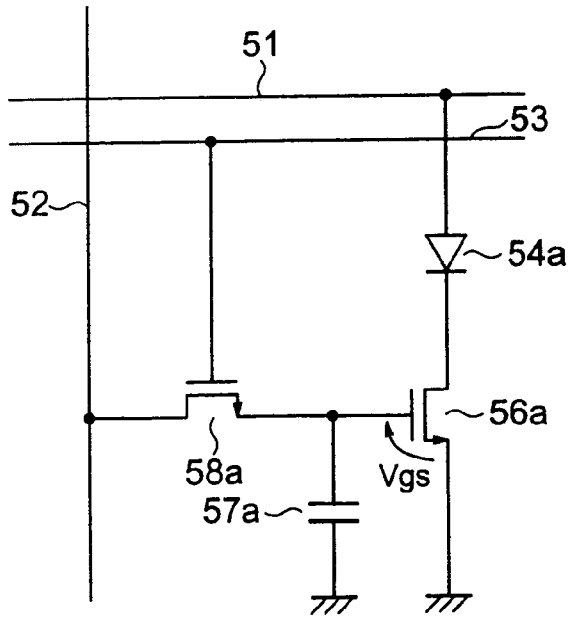

Based on the above, embodiments of the present invention will be described below with reference to the drawings. First, prior to description of the embodiments, causes of occurrence of unevenness of luminance among pixels in an organic EL display device will be described with reference to FIG. 9A and FIG. 9B. FIG. 9A and FIG. 9B are equivalent circuit diagrams each showing a configuration of each pixel of the organic EL display device as comparison examples. FIG. 9A shows a configuration using p-channel transistors 56 and 58 as the thin film transistors (TFTs), and FIG. 9B shows a configuration using n-channel transistors 56*a* and 58*a* as the thin film transistors.

In the case shown in FIG. 9A, an organic EL element 54 being a light emitter is formed based on ground, and in the case shown in FIG. 9B, an organic EL element 54*a* being a light emitter is formed based on the power supply. Numerals 57 and 57*a* denote image signal holding capacitors, a numeral 51 denotes a power supply line, a numeral 52 denotes an image signal line, and a numeral 53 denotes a scanning line. The image signal line 52 is commonly connected to other pixels in the longitudinal (column) direction, and the scanning line 53 is commonly connected to other pixels in the horizontal (row) direction though not shown.

To the image signal line 52, an image signal is supplied in an analog value (voltage) and a pixel selection signal is supplied to the scanning line 53 concurrently therewith. When the pixel selection signal is supplied to the scanning line 53, the transistor 58 (58*a*) is brought into a conductive state to charge/discharge the image signal holding capacitor 57 (57*a*) in accordance with the voltage of the image signal on the image signal line 52. The capacitor 57 (57*a*) holds the voltage until the transistor 58 (58*a*) is brought into a next conductive state. The transistor 56 (56*a*) controls its drain current in accordance with the voltage held by the capacitor 57 (57*a*).

Here the input voltage (gate-source voltage Vgs) versus output voltage (drain current Ids) characteristics of the transistor 56 (56*a*) are expressed by the following equation. Specifically, $Ids=(1/2)\cdot\mu\cdot Cox\cdot(W/L)\cdot(Vgs-Vth)^2$ where $\mu$ indicates the carrier mobility, Cox indicates the gate capacity per unit area, W indicates the channel width, L indicates the channel length, and Vth indicates the threshold voltage. As understood from this equation, when the threshold voltage Vth varies among pixels, the output current (drain current Ids) varies with square characteristics (that is, very sensitively) to the same input voltage (gate-source voltage Vgs). The drain current Ids is the current to be fed to the organic EL element 54 (54*a*) as it is and thus causes variations in current, that is, variations in luminance.

For the TFT as the transistor 56 (56*a*), polycrystal silicon having excellent current drive capability is often used as the material of channel thereof, and its threshold voltage Vth actually varies, for example, by about several tens of mV due to characteristics of the element. Therefore it is impossible to eliminate variations in luminance among pixels as a display device in these comparison examples. Besides, when employing a design in which the center value of Vth is made small to decrease the variations in the drain current Ids, the drain current Ids is increased, undesirably making it impossible to reduce power consumption as the organic EL display device.

In contrast, FIG. 1 is a block diagram showing a configuration of a particular pixel in an organic EL display device according to an embodiment of the present invention. As shown in FIG. 1, this pixel is connected individually with a power supply line 1, an image signal line 2, and a scanning line 3 and has a light emitter 4, a current detector 5, a current controller 6, an image signal holding capacitor 7, a first switching unit 8, a second switching unit 9, and a comparison amplifier 10. The scanning line 3 is commonly connected to other pixels in the horizontal (column) direction though not shown.

The light emitter 4 is an organic EL element formed based on ground, and its anode side is connected to a current output terminal of the current controller 6. The current controller 6 controls the current flowing from the current detector 5 to the light emitter 4, and its control input terminal is connected to one end of the capacitor 7 so that the control is conducted in accordance with the voltage held by the voltage holding capacitor 7. The current detector 5 is connected between the power supply line 1 and the current controller 6 to detect the current as a result of the control by the current controller 6. The detected current is led to the first switching unit 8 as a voltage value.

The first switching unit 8, which is provided between the current detector 5 and an inverting input terminal of the comparison amplifier 10, switches between transmission and non-transmission based on the pixel selection signal from the scanning line 3 to lead the voltage value led from the current detector 5 to the comparison amplifier 10 when transmission. The second switching unit 9, which is provided between an output of the comparison amplifier 10 and one end of the image signal holding capacitor 7/a control input terminal of the current controller 6, switches between transmission and non-transmission based on the pixel selection signal from the scanning line 3 to lead the output voltage of the comparison amplifier 10 to the one end of the image signal holding capacitor 7 and the control input terminal of the current controller 6 when transmission.

The comparison amplifier 10 has a function of subtracting the voltage of the inverting input terminal from the voltage of a noninverting input terminal and outputting the result after amplifying it with a large gain, and its inverting input terminal and output are connected to the first or second switching unit 8 or 9 as described above and its noninverting input terminal is supplied with the image signal from the image signal line 2. Note that a broken line 2B drawn to join into the inverting input terminal of the comparison amplifier 10, a broken 2A line drawn to extend from the output of the comparison amplifier 10, and a long broken line 20 drawn to extend from the image signal line 2 will be described later.

With the pixel of the organic EL display device having the configuration shown in FIG. 1, where the image signal is supplied to the image signal line 2 and the pixel selection signal is supplied to the scanning line 3 to close the first and second switching units 8 and 9, the output voltage of the current detector 5 is the voltage substantially equal to the image signal. This is because a loop starting from the current detector 5, the first switching unit 8, the comparison amplifier 10, the second switching unit 9, the current controller 6, returning to the current detector 5 forms a negative feedback path, the relationship between the noninverting input and the inverting input of the comparison amplifier 10 is brought into an imaginary short state.

Accordingly, the current at the current detector 5 is of a value matching the image signal supplied to the image signal line 2, and the matched current flows to the light emitter 4 via the current controller 6. Therefore, variations in current flowing through the light emitters 4 are eliminated in principle. This results in elimination of variations in luminance among pixels. In other words, a voltage is generated in the image signal holding capacitor 7 by the above-describe negative feedback path, which is a voltage making the current value of the light emitter 4 constant irrespective of variations in the input voltage versus output current characteristics of the current controller 6.

As the easiest configuration of the display device, pixels having the above-described configuration are arranged vertically (column) and horizontally (row). In this case, the image signal line 2 is extended like the long broken line 20 and provided to be commonly connected to other pixels in the vertical (column) direction. Lead wires corresponding to the broken lines 2A and 2B are not provided. In this case, however, it becomes necessary to build in the comparison amplifier 10 in addition to the first and second switching units 8 and 9 for each pixel, bringing about a disadvantage in aperture rate (rate of net area of light emitter to surface area).

Hence, a configuration is conceivable in which the comparison amplifier 10 does not need to be provided in each pixel. Specifically, the broken line 2B drawn to join into the inverting input terminal of the comparison amplifier 10 and the broken line 2A drawn to extend from the output of the comparison amplifier 10 are provided as lead wires which are commonly connected to each pixel in the column direction. A lead wire corresponding to the long broken line 20 is not provided. No comparison amplifier 10 is provided in each pixel not shown connected with the broken lines 2B and 2A.

In such a configuration, the first switching unit 8 is a multiplexer which selects the output of the current detector 5 in each pixel in the column direction, and the second switching unit 9 is a demultiplexer which distributes the output of the current comparison amplifier 10 to the image signal holding capacitor 7 in each pixel in the column direction. The selection and distribution are performed by the pixel selection signal supplied to the scanning line 3. With such a configuration, only one comparison amplifier 10 needs to be provided at a minimum for each column, thus the necessity for building it on a display surface as a display device, so that a great effect can be obtained in terms of an increase in the aperture rate. It should be noted that another configuration is also employable in which the comparison amplifier 10 is provided, not one for each column but one for pixels in each of a plurality of rows in each column.

Figure 2:
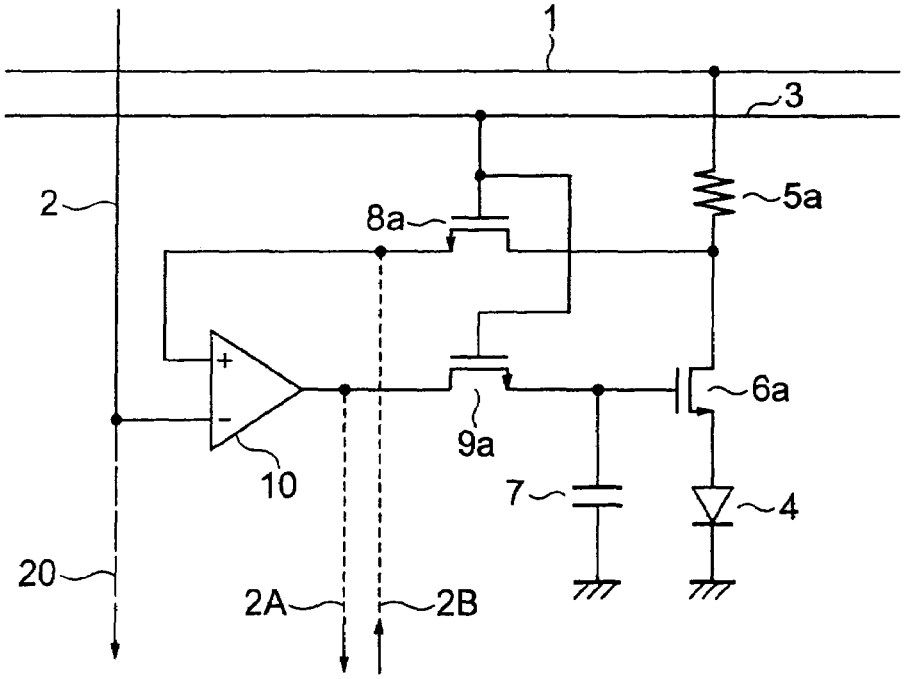
FIG. 2 is a circuit diagram showing an example in which concrete elements are applied to blocks in the embodiment shown as the block diagram in FIG. 1.

FIG. 2 is a circuit diagram showing an example in which concrete elements are applied to blocks in the embodiment shown as the block diagram in FIG. 1. In FIG. 2, the same numbers are assigned to components which are substantially the same as those in FIG. 1. In this example, a resistor 5*a* is used as the current detector 5, n-channel transistors 6*a*, 8*a*, and 9*a* are used as the current controller 6, the first switching unit 8, and the second switching unit 9, respectively. The transistors 6*a*, 8*a*, and 9*a* can be thin film MOS transistors formed on a glass substrate as known. Note that since the detection polarity of the resistor 5*a*, as the current detector, is inverted in such a circuit, the input terminals of the comparison amplifier 10 are arranged in reverse to those shown in the case of FIG. 1.

The supplement of the description on the connection of the n-channel transistors 6*a*, 8*a*, and 9*a* is as follows. The source of the transistor 6*a* is connected to the anode of the light emitter 4, the drain is connected to one end of the resistor 5*a*, and the gate is connected to one end of the image signal holding capacitor 7. The gate, drain, and source of the transistor 8*a* are connected to the scanning line 3, the one end of the resistor 5*a*, and the noninverting input terminal of the comparison amplifier 10, respectively. The gate, drain, and source of the transistor 9*a* are connected to the scanning line 3, the output of the comparison amplifier 10, and the one end of the image signal holding capacitor 7, respectively. Note that the transistors 8*a* and 9*a* perform switching actions and thus their sources and drains can also be reversed.

In this configuration example, the resistor 5*a* can be used as the current detector 5 to thereby easily detect the voltage value in proportion to the current flowing therethrough.

Figure 3:
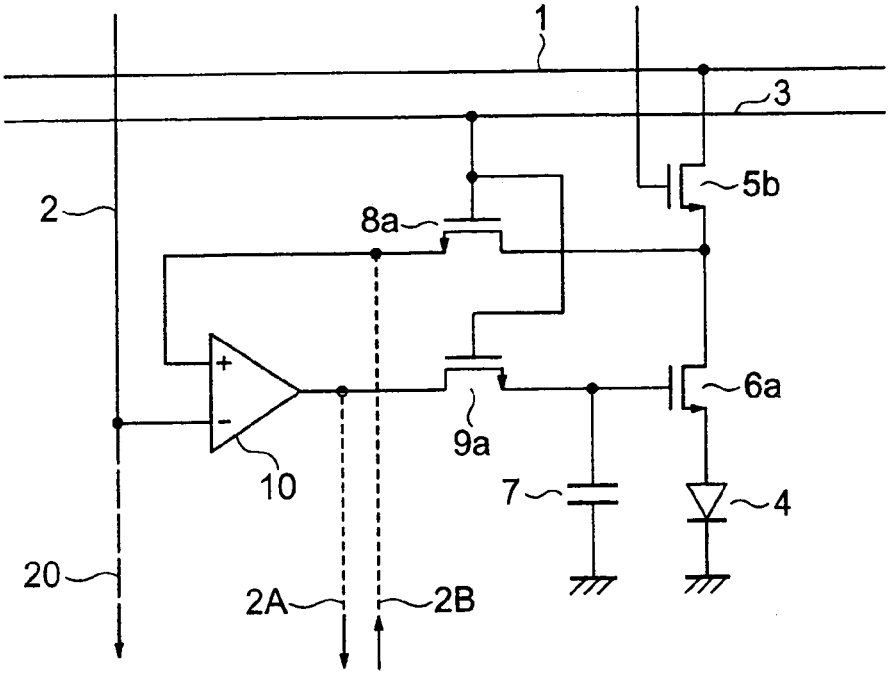
FIG. 3 a circuit diagram showing an example in which concrete elements are applied to blocks in the embodiment shown as the block diagram in FIG. 1, different from the configuration shown in FIG. 2.

FIG. 3 is a circuit diagram showing an example in which concrete elements are applied to blocks in the embodiment shown as the block diagram in FIG. 1, different from the configuration shown in FIG. 2. In FIG. 3, the same numbers are assigned to components which are substantially the same as those in the already-illustrated drawings, and their description will be omitted.

In this configuration example, the on-state resistance of an n-channel transistor 5*b* is utilized as the current detector 5. Therefore, the drain, source, and gate of the transistor 5*b* are connected to the power supply line 1, the drain of the transistor 6*a* and the drain of the transistor 8*a*, and a not-shown voltage source, respectively. With such a configuration, it becomes unnecessary to build in the resistor 5*a* as an element of a pixel, unlike the configuration shown in FIG. 2, so that the configuration can be composed of almost only n-channel transistors. Accordingly, the manufacturing process of the organic EL display device can be simplified, resulting in an advantage in manufacturing cost.

Figure 4:
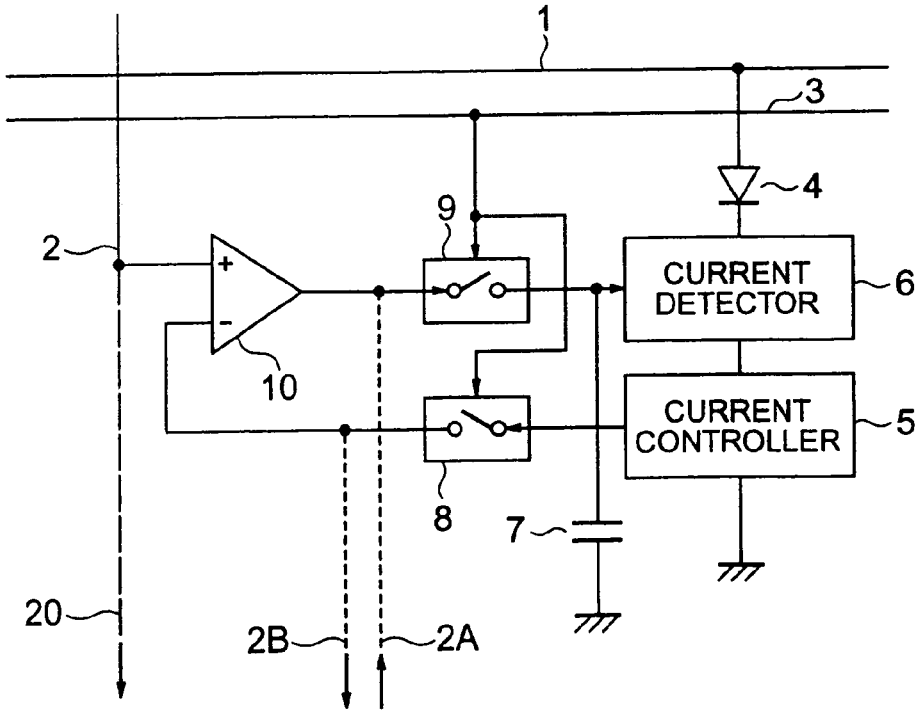
FIG. 4 is a block diagram showing a configuration of a particular pixel in an organic EL display device according to another embodiment of the present invention.

FIG. 4 is a block diagram showing a configuration of a particular pixel in an organic EL display device according to another embodiment of the present invention. In FIG. 4, the same numbers are assigned to components which are substantially the same as those already described, and their description will be omitted. In this embodiment, an organic EL element formed based on the power supply is used as a light emitter 4*a*. This allows current fed to the light emitter 4*a* to flow through a current path from the light emitter 4*a*, a current controller 6, to a current detector 5.

Also in this configuration, a loop starting from the current detector 5, a first switching unit 8, a comparison amplifier 10, a second switching unit 9, the current controller 6, returning to the current detector 5 forms a negative feedback path, so that the output voltage of the current detector 5 is the voltage substantially equal to the image signal supplied to an image signal line 2. Accordingly, the current at the current detector 5 is of a value matching the image signal supplied to the image signal line 2, and the matched current flows to the light emitter 4*a* via the current controller 6. Therefore, variations in current flowing through the light emitters 4*a* are eliminated in principle. This results in elimination of variations in luminance among pixels.

Figure 5:
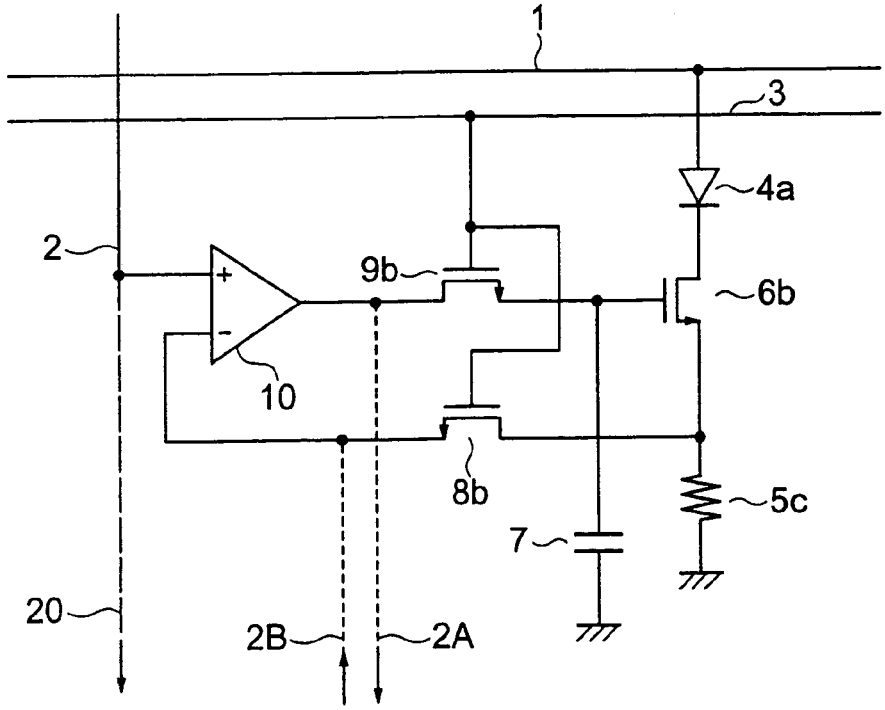
FIG. 5 is a circuit diagram showing an example in which concrete elements are applied to blocks in the embodiment shown as the block diagram in FIG. 4.

FIG. 5 is a circuit diagram showing an example in which concrete elements are applied to blocks in the embodiment shown as the block diagram in FIG. 4. In FIG. 5, the same numbers are assigned to components which are substantially the same as those in FIG. 4. In this example, a resistor 5*c* is used as the current detector 5, n-channel transistors 6*b*, 8*b*, and 9*b* are used as the current controller 6, the first switching unit 8, and the second switching unit 9, respectively. The transistors 6*b*, 8*b*, and 9*b* can be thin film MOS transistors formed on a glass substrate as known.

The supplement of the description on the connection of the n-channel transistors 6*b*, 8*b*, and 9*b* is as follows. The drain of the transistor 6*b* is connected to the cathode of the light emitter 4*a*, the source is connected to one end of the resistor 5*c*, and the gate is connected to one end of the image signal holding capacitor 7. The gate, drain, and source of the transistor 8*b* are connected to the scanning line 3, the one end of the resistor 5*c*, and the noninverting input terminal of the comparison amplifier 10, respectively. The gate, drain, and source of the transistor 9*b* are connected to the scanning line 3, the output of the comparison amplifier 10, and the one end of the image signal holding capacitor 7, respectively. Note that the transistors 8*b* and 9*b* perform switching actions and thus their sources and drains can also be reversed.

Also in this configuration example, the resistor 5*c* can be used as the current detector 5 as in the configuration example shown in FIG. 2 to thereby easily detect the voltage value in proportion to the current flowing therethrough.

Figure 6:
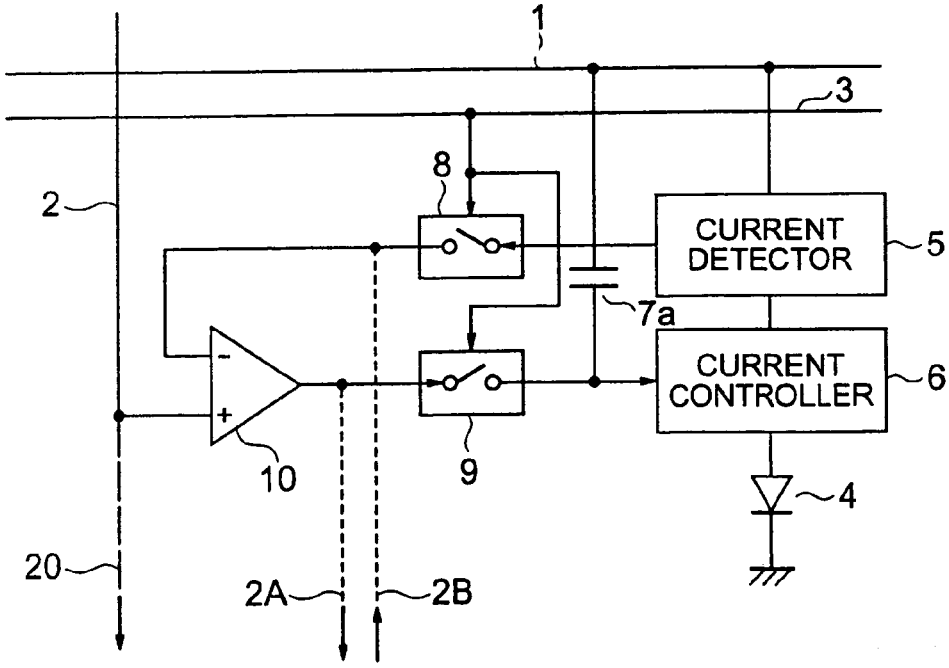
FIG. 6 is a block diagram showing a configuration of a particular pixel in an organic EL display device according to still another embodiment of the present invention.

FIG. 6 is a block diagram showing a configuration of a particular pixel in an organic EL display device according to still another embodiment of the present invention. In FIG. 6, the same numbers are assigned to components which are substantially the same as those already described, and their description will be omitted. In this embodiment, another end of an image signal holding capacitor 7*a* is connected not to ground but to a power supply line 1, unlike the embodiment shown in FIG. 1. There is no difference in operation as a pixel due to the difference between the capacitors 7 and 7*a*.

Figure 7:
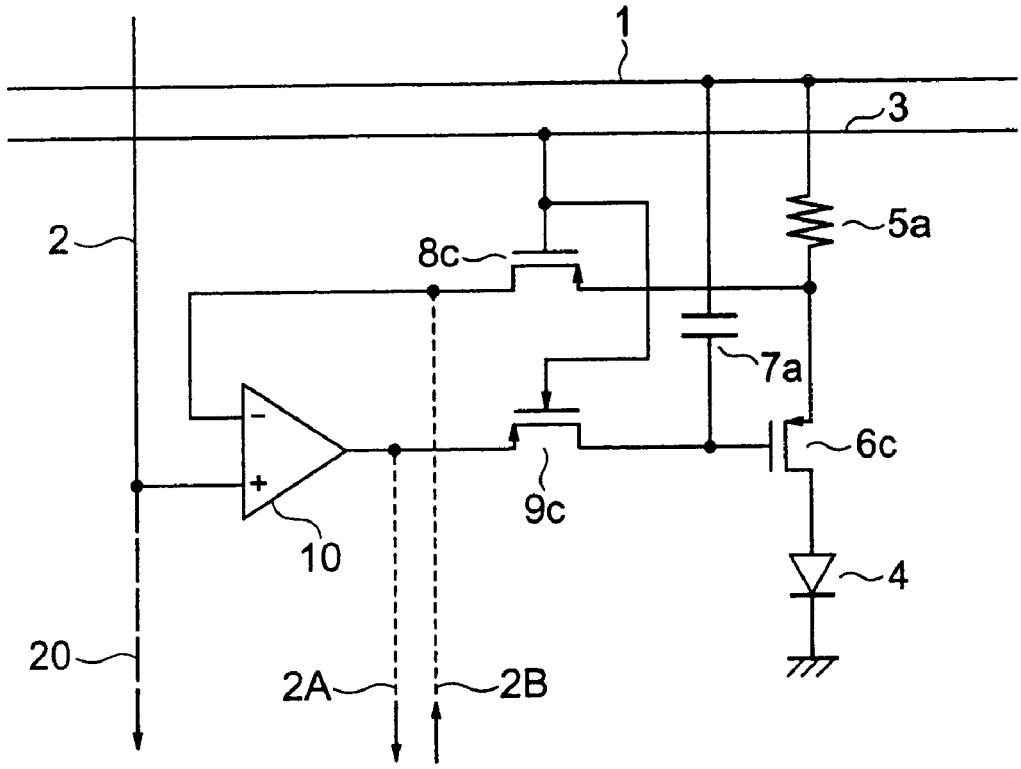
FIG. 7 is a circuit diagram showing an example in which concrete elements are applied to blocks in the embodiment shown as the block diagram in FIG. 6.

FIG. 7 is a circuit diagram showing an example in which concrete elements are applied to blocks in the embodiment shown as the block diagram in FIG. 6. In FIG. 7, the same numbers are assigned to components which are substantially the same as those in FIG. 6. In this example, a resistor 5*a* is used as the current detector 5, p-channel transistors 6*c*, 8*c*, and 9*c* are used as the current controller 6, the first switching unit 8, and the second switching unit; 9, respectively. The transistors 6*c*, 8*c*, and 9*c* can be thin film MOS transistors formed on a glass substrate as known.

The supplement of the description on the connection of the p-channel transistors 6*c*, 8*c*, and 9*c* is as follows. The drain of the transistor 5*a* is connected to the anode of the light emitter 4, the source is connected to one end of the resistor 5*a*, and the gate is connected to one end of the image signal holding capacitor 7*a*. The gate, source, and drain of the transistor 8*c* are connected to the scanning line 3, the one end of the resistor 5*a*, and the noninverting input terminal of the comparison amplifier 10, respectively. The gate, source, and drain of the transistor 9*c* are connected to the scanning line 3, the output of the comparison amplifier 10, and the one end of the image signal holding capacitor 7*a*, respectively. Note that the transistors 8*c* and 9*c* perform switching actions and thus their sources and drains can also be reversed.

Also in this configuration example, the resistor 5*a* can be used as the current detector 5 as in the configuration example shown in FIG. 2 and FIG. 5 to easily detect the voltage value in proportion to the current flowing therethrough. Note that since the detection polarity of the resistor 5*a* as the current detector is not inverted in this configuration example, the input terminals of the comparison amplifier 10 are the same as those shown in the case of FIG. 6.

Figure 8:
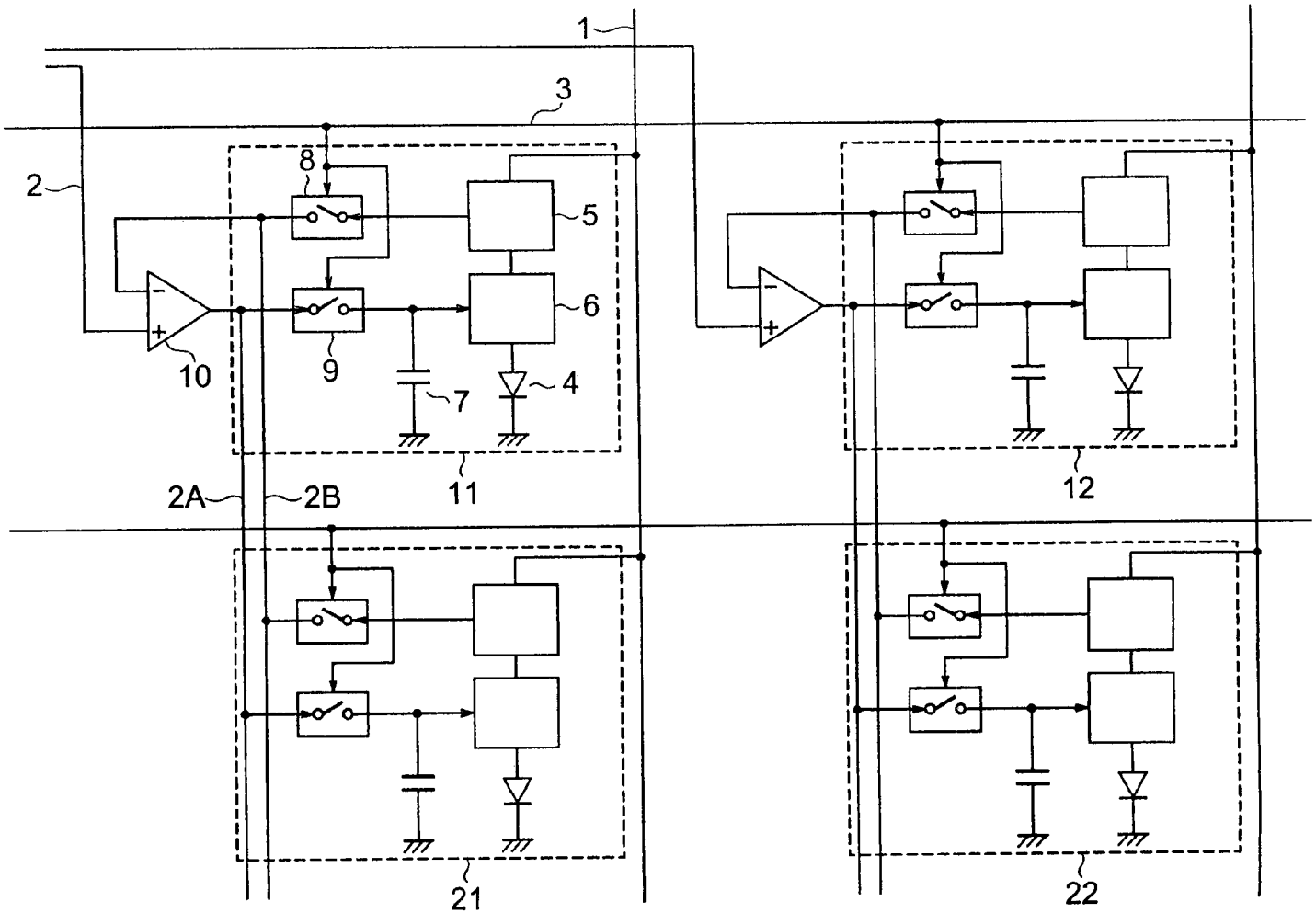
FIG. 8 is a diagram showing the connection between a power supply line 1, an image signal line 2, and a scanning line 3 and pixels where pixels having the configuration shown in FIG. 1 are used and arranged vertically and horizontally.

FIG. 8 is a diagram, repeated illustration of already described ones, showing the connection between the power supply line 1, the image signal line 2, and the scanning line 3 and pixels where pixels having the configuration shown in FIG. 1 are used and arranged vertically and horizontally. In FIG. 8, the same numbers are assigned to components which have been already described. As shown in FIG. 8, pixels are arranged in such a manner that pixels 11, 12, . . . are arrange in the horizontal (row) direction and pixels 11, 21, . . . are arrange in the vertical (column) direction, forming a matrix form as a whole. It is easily understood from this drawing that the comparison amplifier 10 does not need to be provided for each pixel.

It is to be understood that the present invention is not intended to be limited to the specific embodiments described with reference to the drawings and all changes which come within the meaning and range of the claims are therefore intended to be embraced therein.

What is claimed is:

1. An organic EL display device in which a plurality of pixels are arranged in a matrix form, a pixel is selected from among the plurality of pixels in accordance with a pixel selection signal and the selected pixel is caused to emit light in accordance with an image signal, comprising:

a light emitter;

a current controller controlling a current to be fed to the light emitter;

a current detector detecting a value of current flowing through the light emitter as a voltage;

a first switching unit switching between transmission and non-transmission of a voltage value corresponding to the detected current, in accordance with the pixel selection signal;

a comparison amplifier comparing and amplifying the voltage value transmitted from the first switching unit to a voltage value corresponding to the image signal;

a second switching unit switching between transmission and non-transmission of the voltage value being a result of the comparison and amplification, in accordance with the pixel selection signal; and an image signal holding capacitor charged/discharged based on the voltage value transmitted from the second switching unit, wherein the current controller controlling the current to be fed to the light emitter based on a charging voltage of the image signal holding capacitor.

2. The organic EL display device according to claim 1, wherein the current detector is a resistor inserted and connected between a power supply and the current controller; and wherein the light emitter is inserted and connected between the current controller and ground.

3. The organic EL display device according to claim 1, wherein the current detector detects the value of the current flowing through the light emitter as a voltage through use of an on-state resistance of a thin film transistor inserted and connected between a power supply and the current controller.

4. The organic EL display device according to claim 1, wherein the current detector is a resistor inserted and connected between ground and the current controller; and wherein the light emitter is inserted and connected between the current controller and a power supply.

5. The organic EL display device according to claim 1, wherein the light emitter, the current controller, the current detector, the first switching unit, the second switching unit, and the image signal holding capacitor are provided in each of the plurality of pixels;

wherein the comparison amplifier is provided for each column of the pixels in the matrix form;

wherein the first switching unit of every pixel included by a column of pixels to which the comparison amplifier belongs is connected to the comparison amplifier; and wherein the comparison amplifier is connected to the second switching unit of every pixel included by a column of pixels to which the comparison amplifier belongs.

6. The organic EL display device according to claim 2, wherein the current controller is an n-channel thin film transistor outputting the current to be fed to the light emitter as a drain/source current which is controlled by a voltage charged by the image signal holding capacitor and supplied to a gate.

7. The organic EL display device according to claim 2, wherein the current controller is a p-channel thin film transistor outputting the current to be fed to the light emitter as a source/drain current which is controlled by a voltage charged by the image signal holding capacitor and supplied to a gate.

8. The organic EL display device according to claim 4, wherein the current controller is an n-channel thin film transistor outputting the current to be fed to the light emitter as a drain/source current which is controlled by a voltage charged by the image signal holding capacitor and supplied to a gate.

* * * * *